US011688224B2

(12) United States Patent
Chan et al.

(10) Patent No.: US 11,688,224 B2
(45) Date of Patent: Jun. 27, 2023

(54) VENDING MACHINE FOR HOT PACKAGED FOOD

(71) Applicant: Kamakura Foods Limited, Hong Kong (CN)

(72) Inventors: Wing Chi Stephen Chan, Hong Kong (CN); Jun Chen, Hong Kong (CN); Sing Ng, Hong Kong (CN)

(73) Assignee: Kamakura Foods Limited, Hong Kong (CN)

( * ) Notice: Subject to any disclaimer, the term of this patent is extended or adjusted under 35 U.S.C. 154(b) by 100 days.

(21) Appl. No.: 17/301,580

(22) Filed: Apr. 8, 2021

(65) Prior Publication Data

US 2022/0327885 A1 Oct. 13, 2022

(51) Int. Cl.
*G07F 11/48* (2006.01)
*G07F 17/00* (2006.01)

(52) U.S. Cl.
CPC ..... *G07F 11/48* (2013.01); *G07F 17/0078* (2013.01)

(58) Field of Classification Search
CPC ..... G07F 11/48; G07F 17/0078
USPC ..... 221/188
See application file for complete search history.

(56) References Cited

U.S. PATENT DOCUMENTS 694,968 A * 3/1902 Johnson ..... G07F 11/045 194/291
1,310,826 A * 7/1919 Grover ..... G07F 1/02 194/332
1,495,015 A * 5/1924 Garcia ..... G07F 11/02 194/282
2,444,747 A * 7/1948 Niewoehner ..... G07F 11/045 221/6
3,190,493 A * 6/1965 Johnson ..... G07F 11/30 221/125
3,573,430 A * 4/1971 Eisler ..... H05B 3/565 219/385
3,602,403 A * 8/1971 Klem ..... G07F 11/28 222/251
3,750,804 A * 8/1973 Lemelson ..... G07F 11/1657 414/280
4,405,059 A * 9/1983 Kull ..... B65G 47/8884 221/129
4,717,044 A * 1/1988 Suzuki ..... G07D 1/00 221/195

(Continued)

*Primary Examiner* — Rakesh Kumar
(74) *Attorney, Agent, or Firm* — S&F/WEHRW

(57) ABSTRACT

The invention provides a vending machine for dispensing hot packaged food. The vending machine includes a storage and dispenser unit comprising plural dispensing trays arranged in an array for storing one or more packaged foods, a frame, and a carrier structure. Each individual dispensing tray includes a pivotable gate and a slideway inclined by a tilting angle from a horizontal axis. The carrier structure comprises a carrying arm having an engaging feature; and an engaging mechanism for actuating the pivotable gate. The engaging mechanism is configured to move the carrying arm towards the individual dispensing tray such that the engaging feature actuates the pivotable gate from a locked position to an unlocked position. The packaged food is prevented from sliding down when the pivotable gate is at the locked position. The packaged food is slidable relative to the individual dispensing tray when the pivotable gate is at the unlocked position.

18 Claims, 8 Drawing Sheets

(56) References Cited

U.S. PATENT DOCUMENTS

| | | | | | |
|---|---|---|---|---|---|
| 5,088,607 | A * | 2/1992 | Risafi | A47F 1/125 | 211/59.3 |
| 5,121,854 | A * | 6/1992 | Trouteaud | G07F 9/02 | 221/21 |
| 5,224,659 | A * | 7/1993 | Gabardi | B02C 17/205 | 241/34 |
| 5,397,025 | A * | 3/1995 | Lee | B65G 59/066 | 221/298 |
| 5,579,952 | A * | 12/1996 | Fiedler | G07F 9/105 | 219/521 |
| 5,990,452 | A * | 11/1999 | Shelton | A47J 37/0842 | 219/393 |
| 6,464,104 | B1 * | 10/2002 | Waddell | G07F 17/0078 | 221/150 A |
| 6,808,082 | B2 * | 10/2004 | Ohkubo | G07F 11/58 | 221/133 |
| 7,837,059 | B2 * | 11/2010 | Hieb | G07F 11/10 | 221/133 |
| 8,162,174 | B2 * | 4/2012 | Hieb | G07F 11/32 | 221/133 |
| 11,417,164 | B2 * | 8/2022 | Xu | G07F 11/1653 | |
| 2002/0038799 | A1 * | 4/2002 | Laken | B29C 66/91218 | 219/535 |
| 2002/0038800 | A1 * | 4/2002 | Laken | B29C 65/3448 | 219/535 |
| 2004/0188455 | A1 * | 9/2004 | Shioya | G07F 11/32 | 221/123 |
| 2010/0169196 | A1 * | 7/2010 | De Luca | G07F 9/105 | 705/34 |
| 2022/0327885 | A1 * | 10/2022 | Chan | G07F 11/48 | |

* cited by examiner

VENDING MACHINE FOR HOT PACKAGED FOOD

FIELD OF THE INVENTION

The present disclosure generally relates to an automatic vending machine for dispensing hot packaged food, and particularly relates to an engaging mechanism and a collection mechanism for the vending machine.

BACKGROUND OF THE INVENTION

In a densely populated area such as railway stations, shopping malls, and office areas, dining is a common problem since restaurants are always full. For people who have limited time for their lunch and/or dinner, buying food from vending machines is a good alternative.

Conventionally, vending machines are commonly used to sell hot or cold canned beverages, and in certain cases, packaged food. For packaged food, the storage compartment generally stores either uncooked food or refrigerated cooked food. After dispensing the packaged food, the customer needs to reheat the packaged food with a microwave oven before consumption. It will be more convenient if the packaged foods are cooked and the vending machine can keep the packaged food warm, thereby the customer can consume the foods directly without a further step of reheating.

Furthermore, the structure of the existing vending machines often requires a spring structure or an electromagnetic structure on the dispensing tray for pushing the packaged food out for collection. This structure leads to a more complicated structure with a number of mechanical moving parts connected to the dispensing tray. Therefore, the manufacturing cost and maintenance cost for the vending machine are higher.

Accordingly, there is a need in the art for a vending machine that seeks to address at least some of the above problems. Furthermore, other desirable features and characteristics will become apparent from the subsequent detailed description and the appended claims, taken in conjunction with the accompanying drawings and this background of the disclosure.

SUMMARY OF THE INVENTION

Provided herein is a vending machine that is simple and robust in mechanical design for dispatching hot packaged foods. The vending machine includes a storage and dispenser unit comprising plural dispensing trays arranged in an array for storing one or more packaged foods, a frame, and a carrier structure. Each individual dispensing tray includes a pivotable gate and a slideway inclined by a tilting angle from a horizontal axis. The carrier structure comprises a carrying arm having an engaging feature; and an engaging mechanism for actuating the pivotable gate. The engaging mechanism is configured to move the carrying arm towards the individual dispensing tray such that the engaging feature actuates the pivotable gate from a locked position to an unlocked position. The packaged food is prevented from sliding down when the pivotable gate is at the locked position. The packaged food is slidable relative to the individual dispensing tray when the pivotable gate is at the unlocked position.

According to certain aspects, the pivotable gate comprises an actuating pin and a locking pin; and the engaging feature interacts with the actuating pin to actuate the pivotable gate.

Preferably, the locking pin is rotated from a closed position and an opened position when the engaging feature interacts with the actuating pin.

According to certain aspects, the engaging mechanism comprises one or more pulleys and a belt, wherein the belt is coupled to the carrying arm such that a rotating motion of the one or more pulleys is transferred to a linear movement of the carrying arm.

According to certain aspects, the pivotable gate is spring-loaded such that the pivotable gate is returned to the locked position when the engaging feature is disengaged.

According to certain aspects, the carrier structure comprises a collection mechanism configured to receive the packaged food from the individual dispensing tray, wherein the collection mechanism comprises a first lever arm and a second lever arm, both disposed on the carrying arm.

According to certain aspects, the first lever arm is rotatable between an upright position and a flat position. The first lever arm at the upright position stops a subsequent packaged food from sliding down to the carrying arm. The first lever arm is rotated to the flat position when the engaging feature moves away from the pivotable gate.

Preferably, the first lever arm is rotatable by a sliding force exerted from the packaged food or by a first rotational torque controlled by the collection mechanism.

According to certain aspects, the second lever arm is rotatable between an upright position and a dispensing position. The second lever arm at the upright position blocks and buffers a sliding speed of the packaged food. The second lever arm is rotated to the dispensing position to enable the packaged food to slide down from the carrying arm to a pick-up chamber for collection.

Preferably, the second lever arm is rotatable by a second rotational torque controlled by the collection mechanism.

According to certain aspects, the slideway is made of stainless steel, metal, thermally conductive ceramic, thermally conductive plastic, or a smooth material with good thermal conductivity.

According to certain aspects, the individual dispensing tray further comprises a heating element arranged under the slideway, thereby the heating element and the packaged food are closely fit to realize an effective and rapid heat transfer.

Preferably, the heating element is a tubular heating rod comprising an internal heating coil and a protective cover.

Preferably, the heating element is provided on sidewalls of the slideway.

According to certain aspects, the vending machine further comprises an ultra-high temperature (UHT) sterilization mechanism for sterilizing the slideway. The UHT sterilization mechanism is repeated for all rows of the plural dispensing trays. Any two rows of the plural dispensing trays are not sterilized simultaneously to minimize current surge.

According to certain aspects, a weight block is slidably installed in the slideway to exert a pushing force to the packaged food.

Preferably, the weight block comprises one or more guide bumps. The individual dispensing tray further comprises one or more guide grooves provided at an inner bottom surface of the slideway, the one or more guide bumps are installed in the one or more guide grooves to provide a contact surface with a low friction.

According to certain aspects, the vending machine further comprises a control compartment having a payment unit, a display module, a pick-up chamber, and a central processing unit.

According to certain aspects, the carrying arm is tilted by an inclination angle of 14-33 degrees from the horizontal axis.

According to certain aspects, the individual dispensing tray comprises one or more heat insulation layers for maintaining a different temperature on the slideway, wherein the heat insulation layer is made of an aerogel thermal insulation material, or other materials with high temperature resistance.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Other aspects and advantages of the present invention are disclosed as illustrated by the embodiments hereinafter.

BRIEF DESCRIPTION OF THE DRAWINGS

The appended drawings contain figures to further illustrate and clarify the above and other aspects, advantages, and features of the present disclosure. It will be appreciated that these drawings depict only certain embodiments of the present disclosure and are not intended to limit its scope. It will also be appreciated that these drawings are illustrated for simplicity and clarity and have not necessarily been depicted to scale. The present disclosure will now be described and explained with additional specificity and detail through the use of the accompanying drawings in which.

DETAILED DESCRIPTION OF THE INVENTION

The following detailed description is merely exemplary in nature and is not intended to limit the disclosure or its application and/or uses. It should be appreciated that a vast number of variations exist. The detailed description will enable those of ordinary skilled in the art to implement an exemplary embodiment of the present disclosure without undue experimentation, and it is understood that various changes or modifications may be made in the function and structure described in the exemplary embodiment without departing from the scope of the present disclosure as set forth in the appended claims.

The present disclosure generally relates to an automatic vending machine for dispensing hot packaged food, and particularly relates to an engaging mechanism and a collection mechanism for the vending machine.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The use of any and all examples, or exemplary language (e.g., "such as") provided herein, is intended merely to illuminate the invention better and does not pose a limitation on the scope of the invention unless the claims expressly state otherwise.

When an element is referred to as being "fixed to" or "disposed on" another element, it can be directly on the other element or indirectly on the other element. When an element is said to be "connected to" another element, it can be directly connected to the other element or indirectly connected to the other element. Terms such as "connected", "in communication", "mounted", and variations thereof herein are used broadly and encompass direct and indirect connections, communication and mountings; and are not restricted to electrical, physical or mechanical attachments, connections, or mountings.

Figure 1:
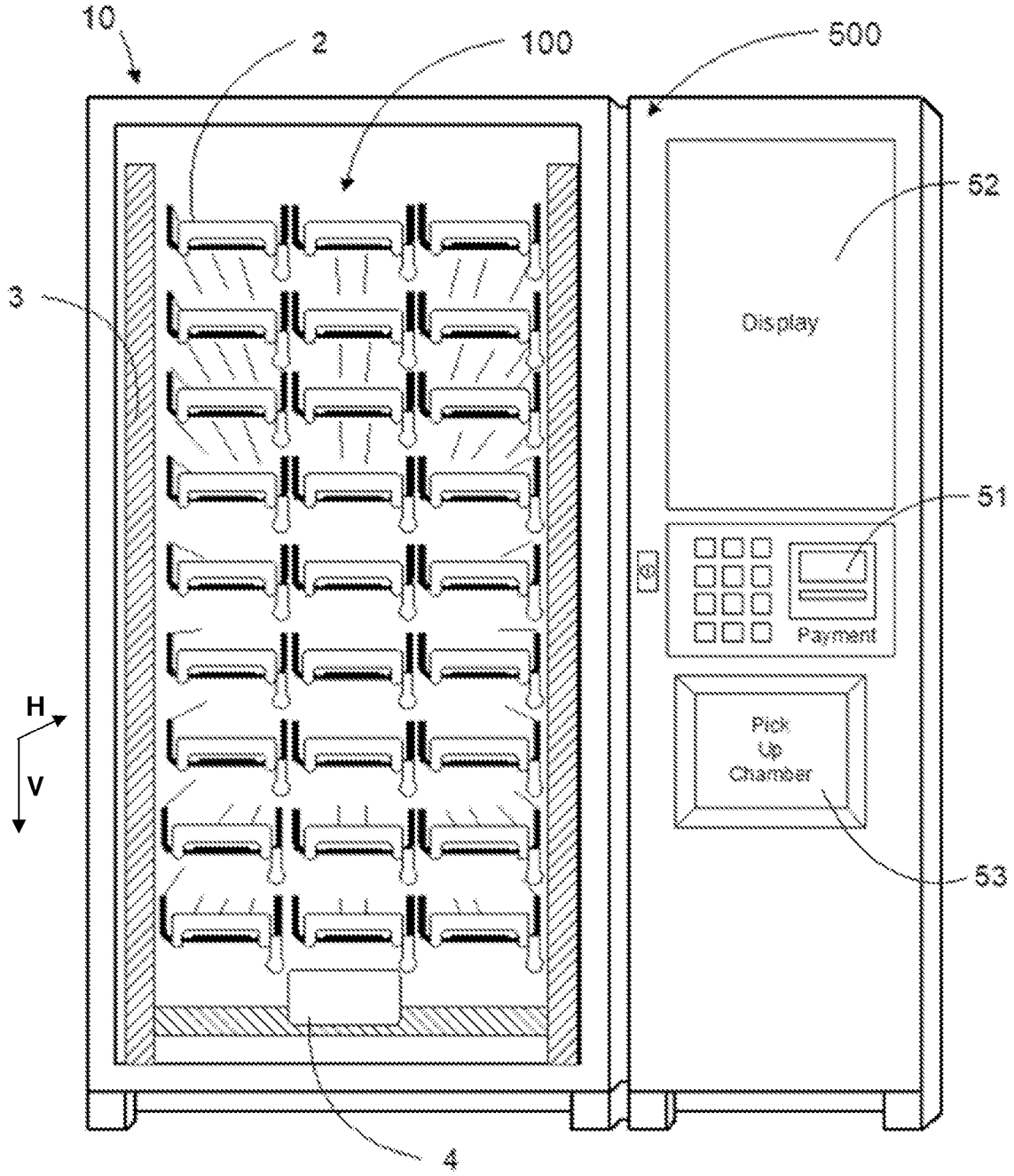
FIG. 1 is the structural diagram of a vending machine in accordance with certain embodiments of the present disclosure.

Terms such as "upper", "lower", "top", "bottom", and variations thereof are used herein for ease of description to explain the positioning of an element, or the positioning of one element relative to another element, and are not intended to be limiting to a specific orientation or position. A vertical axis V is defined by gravity as shown in FIG. 1, extending from the top to the bottom of the storage and dispensing system 10. The horizontal axis H can also be defined as the axis perpendicular to the vertical axis V. Terms such as "first", "second", and variations thereof herein are used to describe various elements, regions, sections, etc. and are not intended to be limiting.

FIG. 1 shows the structural diagram of a vending machine 10 in accordance with certain embodiments of the present disclosure. The vending machine 10 comprises a storage and dispenser unit 100, a control compartment 500 having a payment unit 51, a display module 52, a pick-up chamber 53, and a central processing unit (not shown). Electrical power can be supplied to the vending machine 10, which can be supplied from a battery, a power outlet, or alternatively through a voltage regulator. Interconnecting wiring and cables, power supply housing, and other electronic parts may be used and may be positioned at various locations throughout the vending machine 10 for providing power to at least the storage and dispenser unit 100 and the control compartment 500. For convenience and simplicity, the electrical power and the respective electronic parts or wirings have not been shown in the figures. The display module 52 may include at least a display driver and a display panel, which is connected to the central processing unit. In certain embodiments, the display module 52 comprises a touch screen panel which can also receive control signals from the user. In certain embodiments, the control compartment 500 further includes a communication interface (not shown) for communicating with external devices, a financial transaction terminal, or a cloud database. In such embodiment, the communication interface is configured to support one or more communication protocols, including Ethernet connections, cellular radio connections, Bluetooth, Wireless Body Area Network (WBAN), and Near Field Communication (NFC). Therefore, the central processing unit can report inventory status, error records, and other device information via the communication interface.

In the storage and dispenser unit 100, there are plural dispensing trays 2 arranged in an array, a frame 3, and a carrier structure 4. In certain embodiments, the plurality of dispensing trays 2 is arranged along the horizontal and vertical directions and installed in the frame 3. The frame 3 is simple and strong and capable to hold plural packaged foods 21. Each dispensing tray 2 is used to store the packaged food 21, so that the packaged foods 21 are safely rested inside the storage and dispenser unit 100. The carrier structure 4 is moveable along the frame 3 to engage with each dispensing tray 2 such that the packaged food 21 can be transported from the dispensing trays 2 to the pick-up chamber 53 via the carrier structure 4. The storage and dispenser unit 100 can be opened after cleaning to promote the evaporation of water vapor inside.

Figure 2A:
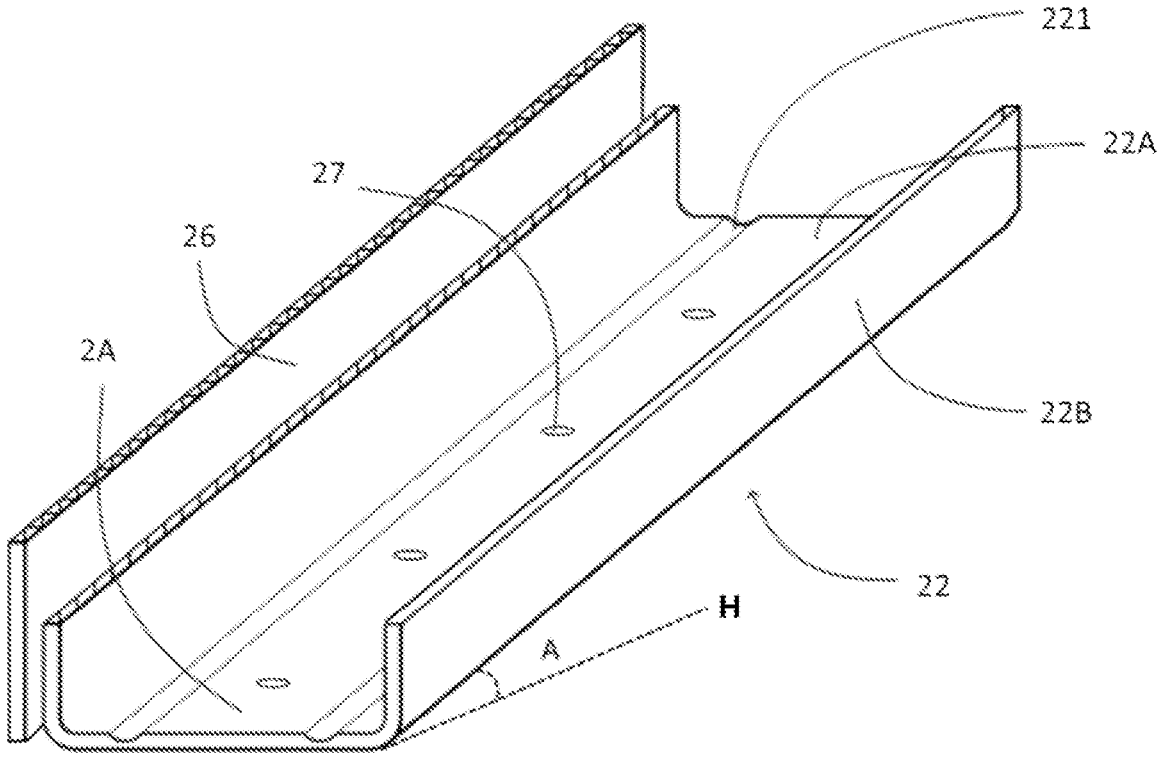
FIG. 2A is a top perspective view of a first configuration of the dispensing tray in accordance with certain embodiments of the present disclosure.
Figure 2B:
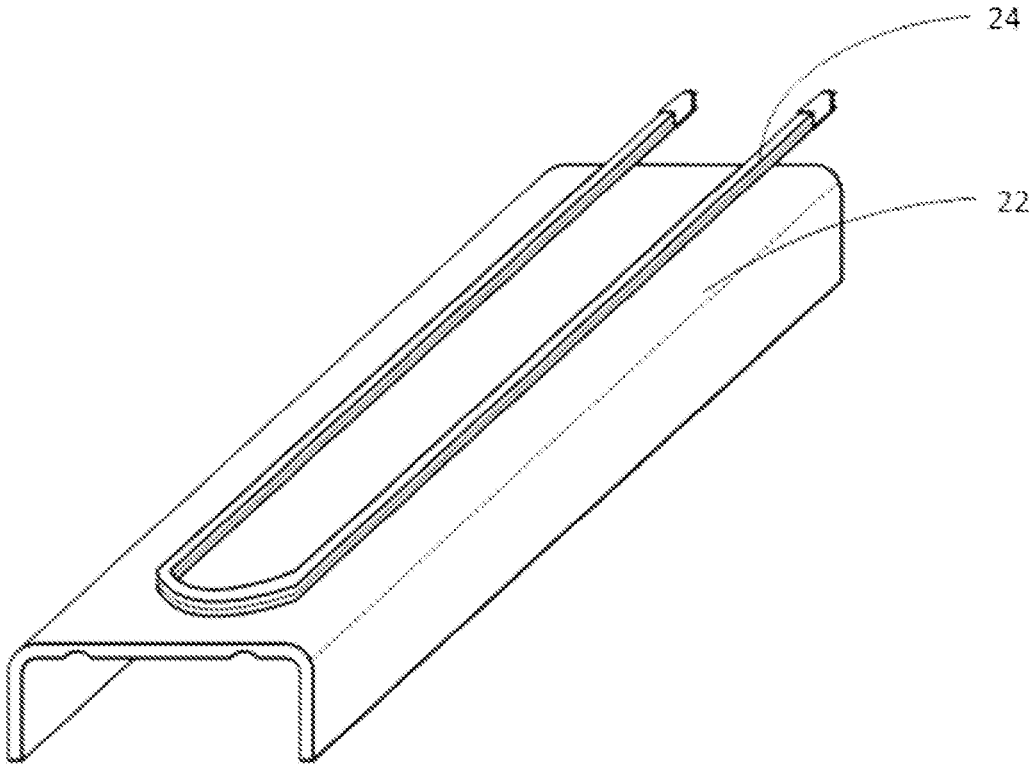
FIG. 2B is a bottom perspective view of the dispensing tray of FIG. 2A.

Referring to FIG. 2A and FIG. 2B, the dispensing tray 2 comprises a U-shaped slideway 22 that is compatible with the peripheral of the packaged food 21, one or more guide grooves 221, and a heating element 24. The slideway 22 is an elongated element defining an inclined path which the packaged food 21 is constrained to travel along. The slideway 22 is inclined by a tilting angle A and the lower end 2A of the dispensing tray 2 is a delivery end where the packaged food 21 slides down from the lower end 2A to the carrier structure 4 by gravitational force. In particular, the slideway 22 may include at least a bottom surface 22A and two sidewalls 22B. The heating element 24 is arranged under the slideway 22, thereby the heating element 24 and the packaged food 21 are closely fit to realize an effective and rapid heat transfer. In particular, the heating element 24 has a U-shaped structure installed on the bottom surface 22A for transferring the heat energy to the bottom side of the packaged food 21. Unlike a centralized hot air circulation system, the temperature of each dispensing tray 2 is configurable to different temperature according to the respective optimal eating temperature of the packaged food 21 thereon, which advantageously provide the user with the convenience without the need of further heating of the packaged food 21.

In order to effectively maintain a different temperature on each slideway 22, each individual dispensing tray comprises one or more heat insulation layers 26 disposed between any two adjacent slideways 22. In certain embodiments, the heat insulation layer 26 is made of an aerogel thermal insulation material, or other materials with high temperature resistance. The heat insulation layer 26 may be in any shape other than a plate, and it may be prefabricated according to the size of the slideway 22 with the required thickness to improve the insulation performance.

Figure 3:
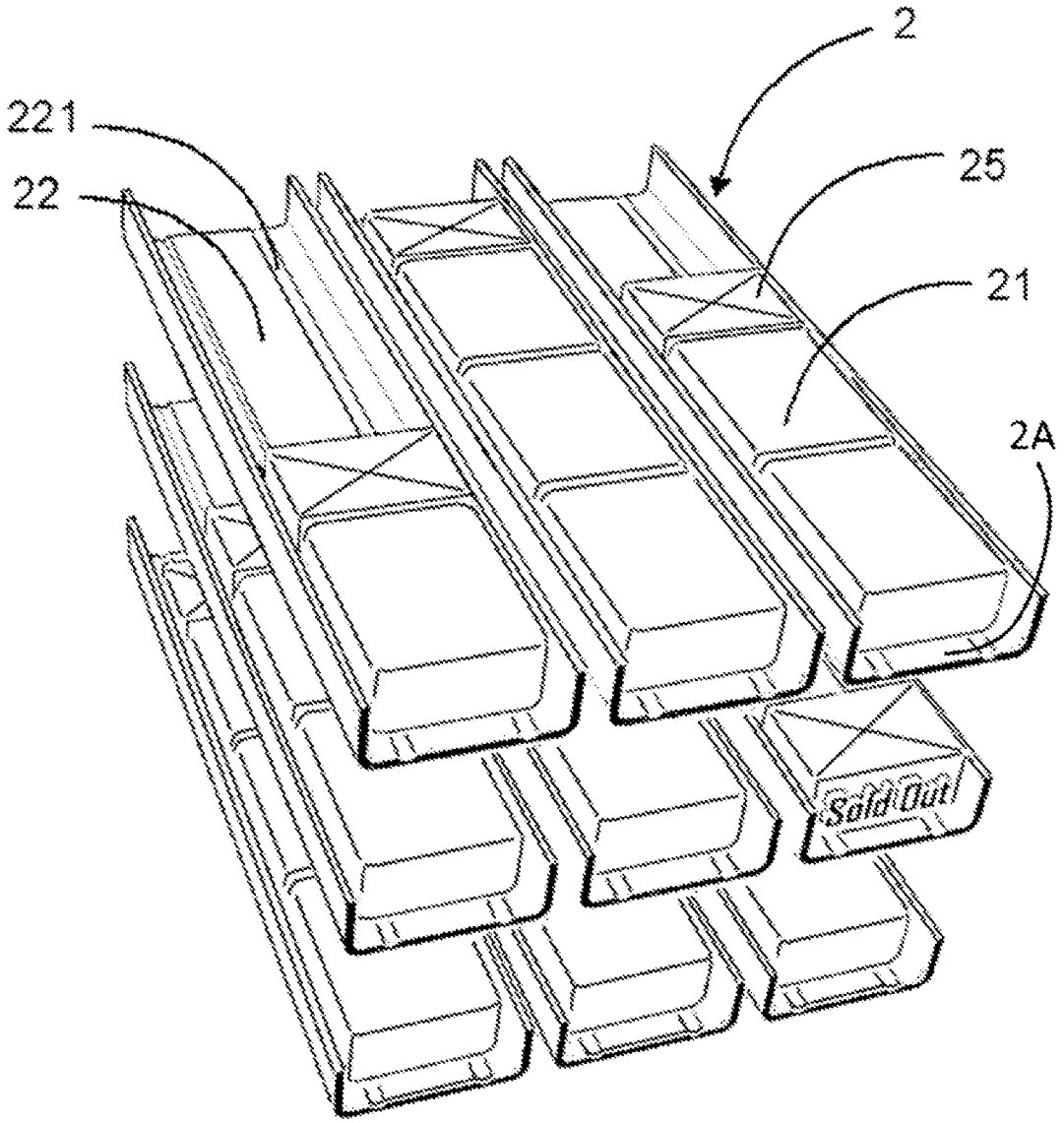
FIG. 3 is a perspective view of an array of dispensing trays in accordance with certain embodiments of the present disclosure.

A specific implementation of the storage and dispenser unit 100 is provided and depicted in FIG. 3, the tilting angle A representing the inclination of the dispensing tray 2 is approximately 10-25 degrees upwards from the horizontal axis H, so that the packaged food 21 can be vividly displayed at a suitable angle. In addition, the tilting angle A is set to make the packaged food 21 freely slide down to the lower end 2A of the slideway 22 under the action of gravity, and can prevent the packaged food 21 from sliding too fast in the slideway 22 if the tilting angle A is too large. Therefore, the packaged food 21 is not likely to deviate from the slideway 22 during the slide.

Figure 4A:
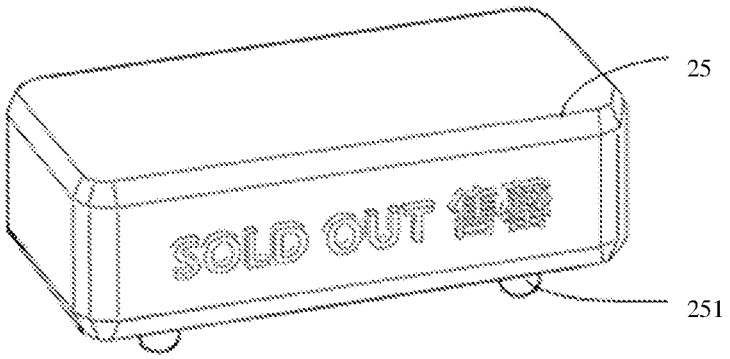
FIG. 4A is a perspective view of the weight block in accordance with certain embodiments of the present disclosure.
Figure 4B:
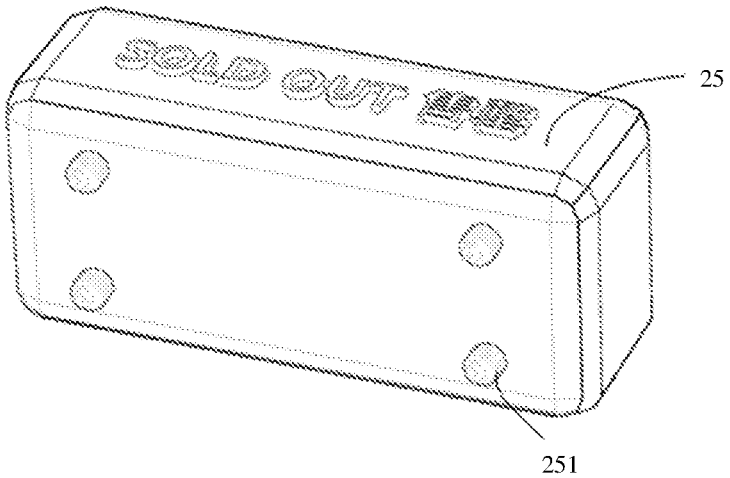
FIG. 4B is a bottom perspective view of the weight block of FIG. 4A.

In certain embodiments, as illustrated in FIG. 4A and FIG. 4B, a weight block 25 is slidably installed in each slideway 22, and the weight block 25 can exert a pushing force to the packaged food 21 under the action of gravity, wherein the weight block 25 is a hollow member cast of metal with a considerable weight such that the weight block 25 arranged on the inclined slideway 22 has sufficient force to push the packaged food 21 to the lower end 2A of the slideway 22.

On one hand, if it is necessary to make the slideway 22 tilted and smoothed in such an extent that the packaged food 21 is able to slide down freely by its own gravity, it must ensure that the inner side of the slideway 22 has an extremely high-precision surface. However, such a high-precision surface requires high precision processing with a high cost. In this embodiment, placing the weight block 25 on the slideway 22 provides an extra thrust for the packaged food 21. Therefore, when the packaged food 21 is placed on the slideway 22, the gravitational force applied on the weight block 25 can overcome the frictional force of the inner wall of the slideway 22, thereby this can reduce the precision requirements on the inner surface of the slideway 22 and minimize the processing costs.

On the other hand, in order to make the packaged food 21 suitable and expressively displayed, the slideway 22 can only be inclined by a small angle. In this case, the packaged food 21 can slide down to the lower end 2A depending on the surface material of the packaging of the packaged food 21 and the slideway 22. It is possible to offset the downward force caused by gravity, and the weight block 25 is provided in the slideway 22 to provide extra thrust for the packaged food 21 to ensure that the packaged food 21 can smoothly and efficiently slide to the lower end 2A. In addition, as compared with the use of a spring mechanism or an elastic member as the pusher for the packaged food 21, the compressive elastic force is pushed out in a straight direction and requires a limit mechanism to fix the elastic member in the slideway 22. In contrast, the weight block 25 slides due to its own gravity and does not need to install a limit mechanism in the slideway 22 to correct the movement path, which reduces the connection between the movable parts of the storage and dispenser unit 100. Therefore, the structure of the present disclosure is simple and cost-effective.

Further, the weight block 25 comprises one or more guide bumps 251 while the dispensing tray 2 comprises one or more guide grooves 221 provided at an inner bottom surface 22A of the slideway 22. Preferably, there are two guide grooves 221 and four guide bumps 251. The four guide bumps 251 are symmetrically distributed at the bottom of the weight block 25, and the four guide bumps 251 are installed in the guide groove 221 of the slideway 22. The contact surface between the guide bump 251 and the guide groove 221 is very small, and guide bump 251 is made of metal with extremely high hardness and smoothness. Therefore, the friction between the weight block 25 and the guide groove 221 is very low, which facilitates the weight block 25 to overcome the friction force and pushes the packaged food 21 downward to slide. In addition, by arranging the guide bump 251 on the corresponding guide groove 221, only the guide bump 251 and the guide groove 221 need to be processed to make minimize the friction. The complexity in finishing the bottom of the weight block 25 and the inner surface of the slideway 22 is reduced, so the manufacturing cost can be reduced.

Figure 5A:
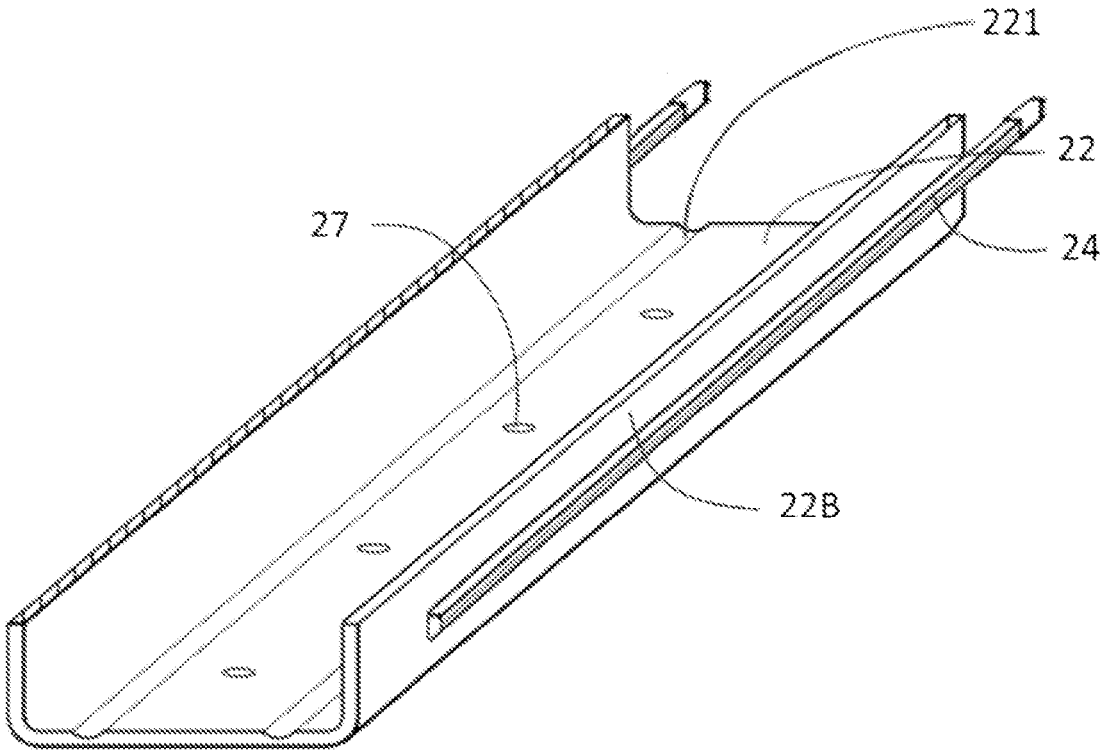
FIG. 5A is a top perspective view of a second configuration of the dispensing tray in accordance with certain embodiments of the present disclosure.
Figure 5B:
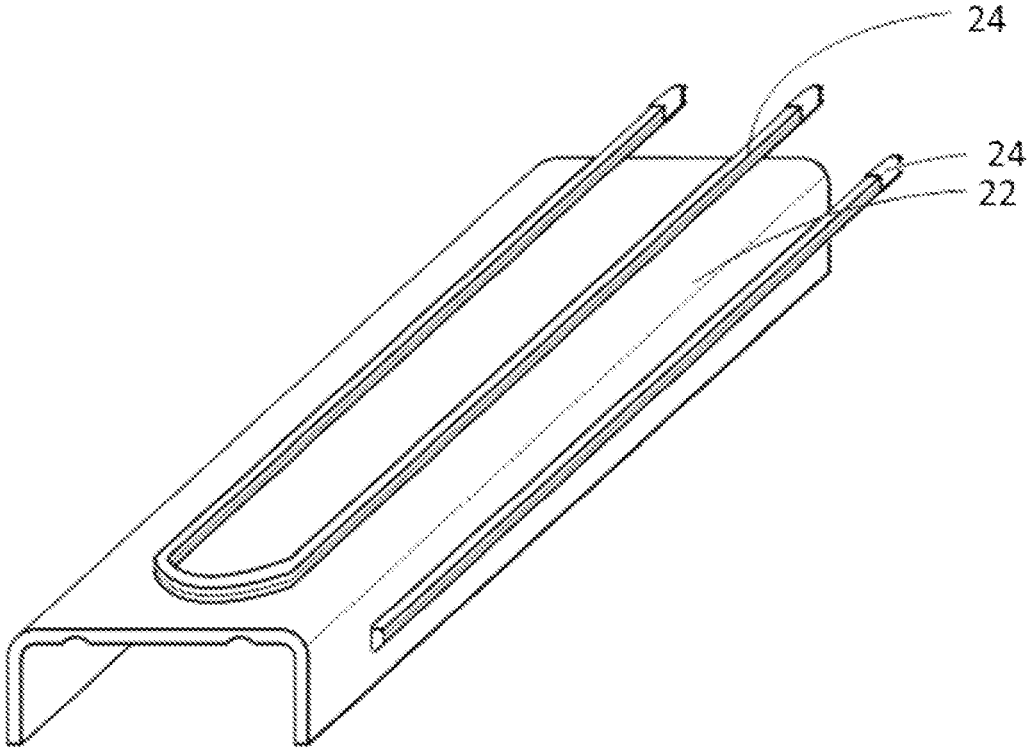
FIG. 5B is a bottom perspective view of the dispensing tray of FIG. 5A.

Now refer to FIG. 5A and FIG. 5B, an alternative structure of the dispensing tray 2 is provided. In this embodiment, the heating element 24 is provided on the bottom surface 22A and the sidewalls 22B of the slideway 22. With the heating element 24 also on the sidewalls 22B, the heating and warming of the packaged food 21 can be more efficient.

In the present disclosure, the heating element 24 is a tubular heating rod comprising an internal heating coil and a protective cover, wherein the internal heating coil is made of nickel-chromium, and the protective cover is made of a stainless-steel alloy, or other components fabricated therefrom. The heating element 24 with the tubular structure has the advantage that (1) the heating coil is a resistive type heating device, which is more economical; (2) the heating element 24 can be supplied from a manufacturer with customized shapes (round tubes or flat tubes), dimensions (length and diameter), power (voltage and current ratings), and bending options (ring and angles); (3) the heating element 24 is mechanically strong and can resist chemical corrosion.

In certain embodiments, the slideway 22 is made of a smooth material with good thermal conductivity, such as stainless steel, metal, thermally conductive ceramic, and thermally conductive plastic. In one further embodiment, the slideway 22 can be satin-finished such that the slideway 22 has enough smoothness facilitating the sliding of the packaged food freely while maintaining a warm tone to meet the user's pursuit of beauty. The slideway 22 is easy to clean and so the sanitation of the packaged food 21 can also be guaranteed. In certain embodiments, the slideway 22 is heated by the heating element 24 to perform an ultra-high temperature (UHT) sterilization mechanism for sterilizing the slideway, while the components on the dispensing tray 2 are configured to sustain such high temperature.

Figure 6:
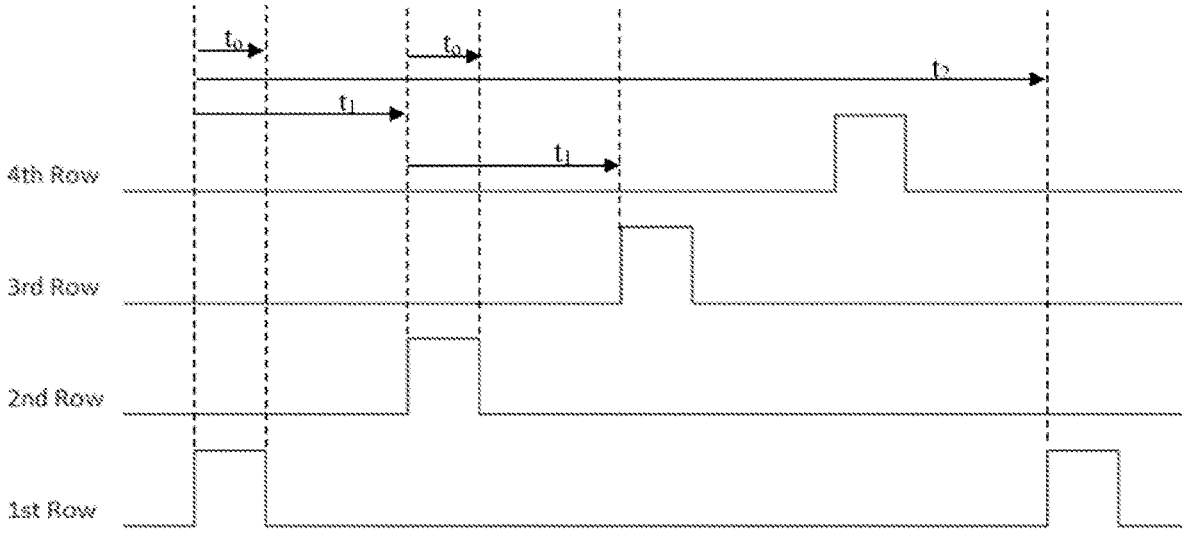
FIG. 6 is a timing diagram illustrating the activation of the heating elements for performing ultra-high temperature sterilization.
Figure 7:
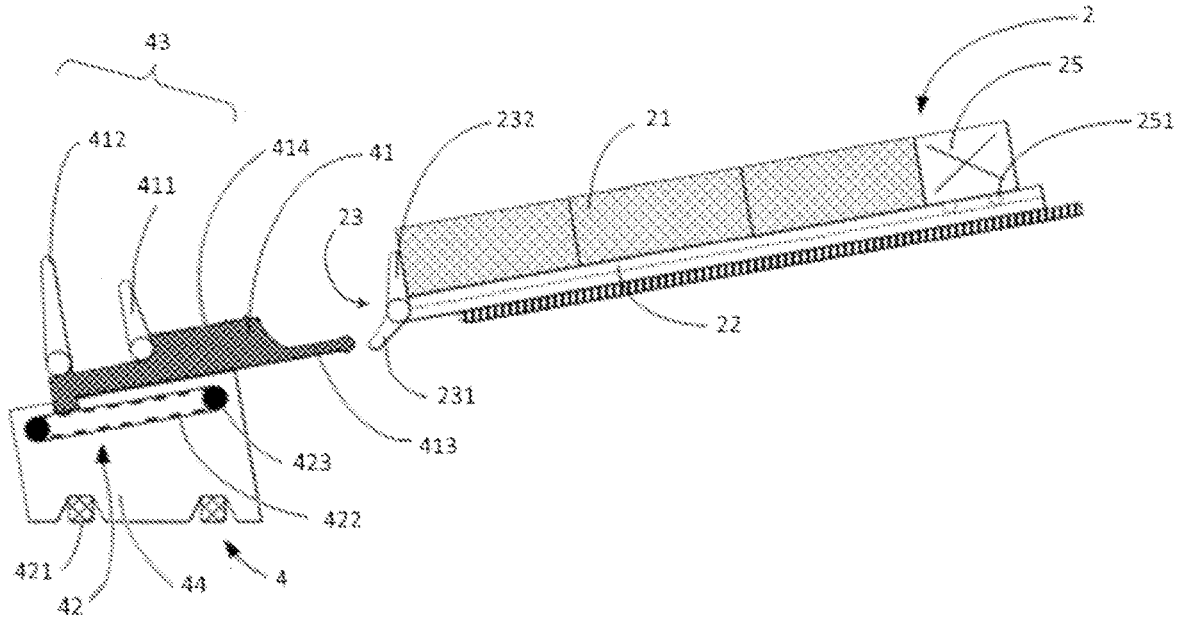
FIG. 7 is a side view of the carrier arm before engaging with the dispensing tray in accordance with certain embodiments of the present disclosure.
Figure 8:
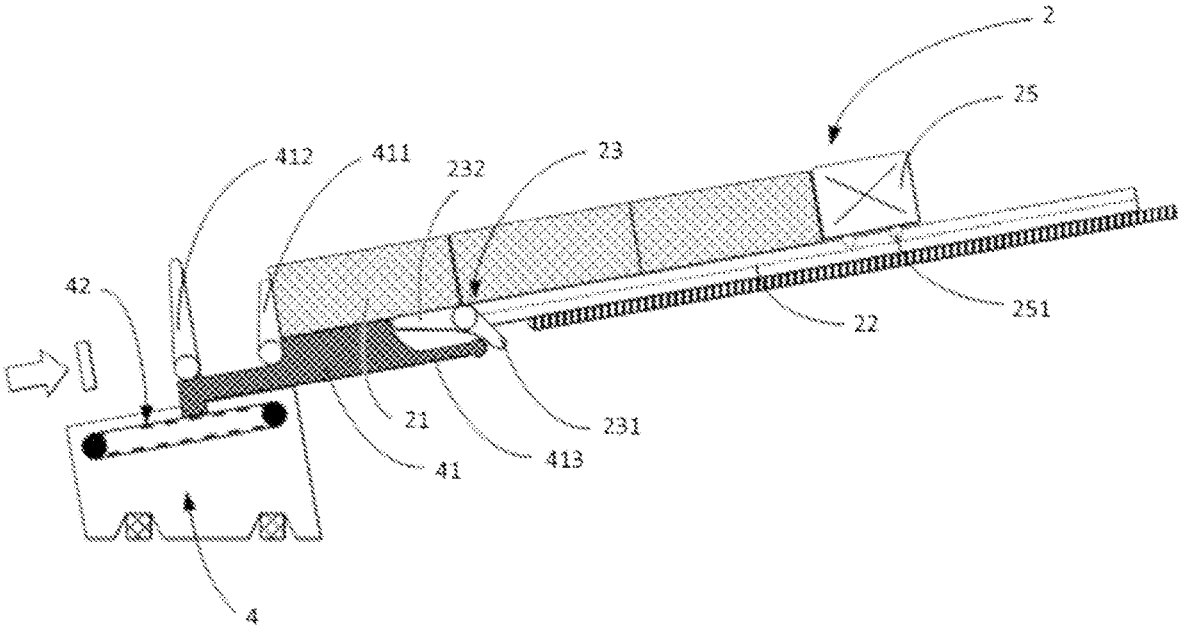
FIG. 8 is a side view of the carrier arm engaging with the dispensing tray in accordance with certain embodiments of the present disclosure.
Figure 9:
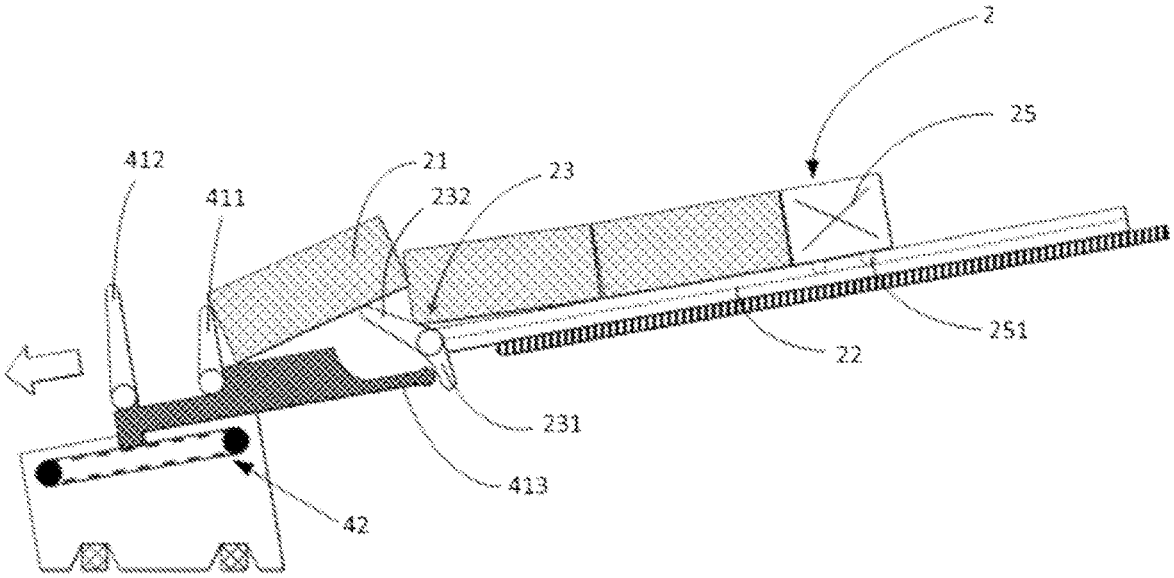
FIG. 9 is a side view of the carrier arm moving away from the dispensing tray in accordance with certain embodiments of the present disclosure.
Figure 10:
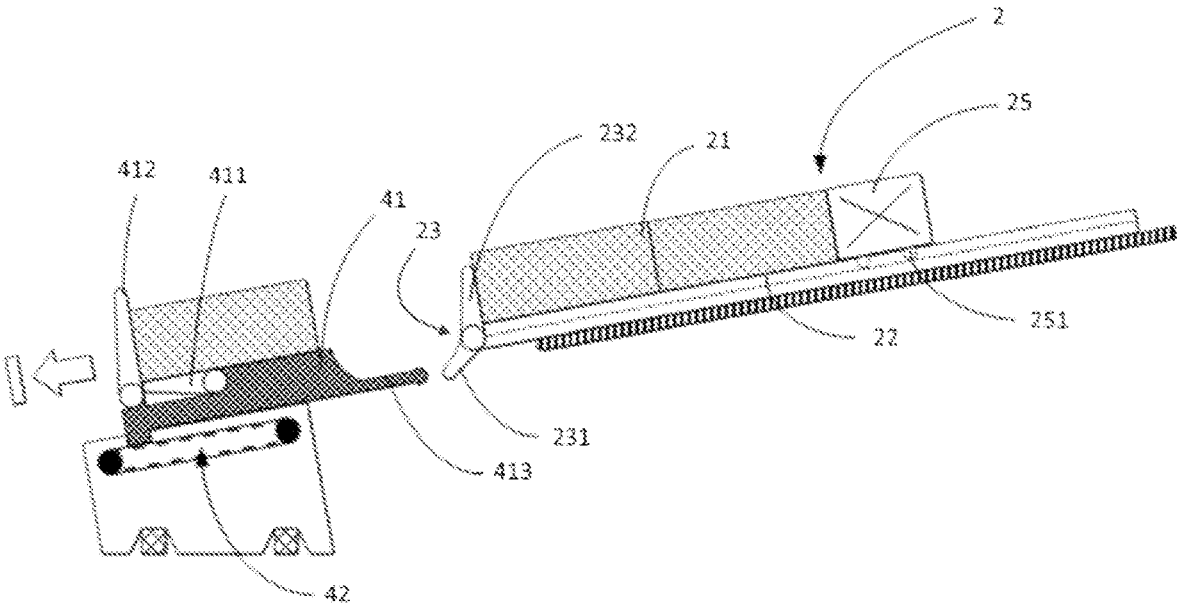
FIG. 10 is a side view of the carrier arm disengaged from the dispensing tray in accordance with certain embodiments of the present disclosure.

The UHT sterilization mechanism is executed according to a predetermined timing as illustrated in the timing diagram of FIG. 6. In the illustrated timing diagram, the storage and dispenser unit 100 has 4 rows of dispensing trays 2. Each row of dispensing tray 2 is sterilized by rapidly heating from room temperature to 140° C. for a first period $t_0$. In one embodiment, the first period $t_0$ is 5 seconds. As the power required and the current surge for performing UHT sterilization is large, it is not preferable to sterilize two rows of dispensing trays 2 simultaneously to minimize current surge. In one embodiment, the delay time $t_1$ for another row of dispensing tray 2 to perform UHT sterilization is 15 seconds. In general, one sterilization cycle is sufficient if the dispensing trays 2 are dry. In case the dispensing trays 2 are wet, extra sterilization cycles may be required. For the same row of dispensing tray 2, the sterilization is only repeated after other dispensing trays 2 in the storage and dispenser unit 100 are sterilized. In one embodiment with 4 rows of dispensing trays 2, the cycle time $t_2$ for performing sterilization again is 60 seconds. Applying the UHT sterilization technology to the dispensing tray 2 will not cause damage to the other parts of the storage and dispenser unit 100. On the other hand, this high temperature and short time treatment can destroy all the microorganisms adhering to the surface of the dispensing tray 2 and ensure the safety of the packaged food 21.

Referring to FIG. 2A and FIG. 5A, one or more temperature sensors 27 are provided on each slideway 22 to measure the temperature of the packaged food 21 in the slideway 22. In certain embodiments, the temperature sensors 27 measure the temperature of the packaged food 21 regularly and couple the temperature data to the central processing unit. When the temperature data shows that the packaged food 21 is not heated to the predetermined optimal temperature range, the central processing unit can control the heating element 24 to raise the temperature of the packaged food 21, and prevent the packaged food 21 from dispensing. When the temperature data shows that the packaged food 21 is heated to the predetermined optimal temperature range, the heating element 24 is stopped, or otherwise the heating element 24 is supplied with a lower power.

FIGS. 7-10 illustrate an engaging mechanism and a collection mechanism for dispensing one packaged food 21 in accordance with certain embodiments of the present disclosure. On the lower end 2A of the dispensing tray 2, a pivotable gate 23 is provided to prevent the packaged food 21 from sliding out of the dispensing tray 2. The pivotable gate 23 is rotatable around an axis to switch between a locked position and an unlocked position. The pivotable gate 23 comprises an actuating pin 231 and a locking pin 232. Preferably, the pivotable gate 23 is rotatable to the locked position to prevent the packaged food 21 from sliding out, and the pivotable gate 23 is rotatable to the unlocked position to allow the packaged food 21 to slide out. In certain embodiments, the pivotable gate 23 is made of stainless steel. The carrier structure 4 is installed on the side of the frame 3 close to the lower end 2A and moveable along the frame 3 to engage with different dispensing tray 2. When an individual dispensing tray 2 is selected by the user, the carrier structure 4 is moved to a position adjacent to the lower end 2A of the individual dispensing tray 2 for collecting the packaged food 21. In certain embodiments, the frame 3 comprises one or more gear racks, lead screws, sliders, pulleys, actuators, and/or other mechanical parts for moving the carrier structure 4 along the frame 3 vertically and horizontally. The carrier structure 4 comprises one or more rotary gears 421 slidable with respect to the frame 3 to enable the movement of the carrier structure 4. In one embodiment, the frame 3 comprises a vertical gear rack and a horizontal gear rack, each mashed with the rotary gears 421 of the carrier structure 4 to convert the rotating movement of the rotary gears 421 into linear motion to move the carrier structure 4 along the frame to engage different dispensing trays 2.

The carrier structure 4 comprises a carrying arm 41, an engaging mechanism 42 for actuating a pivotable gate 23 of a dispensing tray 2, a collection mechanism 43 configured to receive a packaged food 21 from the dispensing tray 2; and a base 44.

The carrying arm 41 is a platform moveable with respect to the base 44 for realizing the engaging mechanism 42. The carrying arm 41 comprises a platform 414 and an engaging feature 413. The engaging mechanism 42 is provided in the base 44 and comprises one or more pulleys 423 and a belt 422. The collection mechanism 43 comprises a first lever arm 411 and a second lever arm 412, both disposed on the carrying arm 41 for facilitating the collection of the packaged food 21. A motor and a drive shaft (not shown) are connected to the pulley 423 for activating the engaging mechanism 42. The belt 422 is connected to the one or more pulleys 423 for driving the belt 422. The belt 422 is coupled to the carrying arm 41 such that the rotating motion of the one or more pulleys 423 is transferred to a linear movement of the carrying arm 41. In certain embodiments, the belt 422 is a flat belt or a toothed belt. It is apparent that the engaging mechanism 42 may drive the carrying arm 41 to a linear movement through other means without departing from the scope and spirit of the present disclosure.

Advantageously, the engaging mechanism 42 is configured to move the carrying arm 41 linearly towards the dispensing tray 2 such that the engaging feature 413 interacts with the actuating pin 231 to actuate the pivotable gate 23 from the locked position to the unlocked position. The locking pin 232 is rotated from a closed position to an opened position to form a bridge between the slideway 22 to the carrying arm 41. The packaged food 21 on the slideway 22 can then slide down from the lower end 2A to the carrying arm 41. As demonstrated in FIG. 7 and FIG. 8, when the pivotable gate 23 is at the locked position, the packaged food 21 placed on the slideway 22 of the dispensing tray 2 is prevented from sliding down; and the packaged food 21 is slidable relative to the dispensing tray 2 when the engaging feature 413 is engaged with the pivotable gate 23 to rotate the pivotable gate 23 to the unlocked position. In certain embodiments, the pivotable gate 23 is spring-loaded, which can be returned to the locked position when the engaging feature 413 is disengaged.

When the pivotable gate 23 is in the unlocked position, the pivotable gate 23 allows the packaged food 21 to slide by bridging the slideway 22 to the carrying arm 41 to form a linear sliding path. The packaged food 21 at the lowest position can slide down by gravitational force to the carrying arm 41 with the collection mechanism 43 configured to receive the packaged food 21 from the dispensing tray 2. The weight block 25 indirectly exerts a pushing force to the packaged food 21 to facilitate the sliding to the carrying arm 41. The first lever arm 411 is rotatable between an upright position and a flat position. When the first lever arm 411 is at the upright position, the first lever arm 411 stops the packaged food 21 from further sliding down. As the platform 414 of the carrying arm 41 can only hold one packaged food 21, the first lever arm 411 can guarantee that the subsequent packaged food 21 on the same dispensing tray 2 stays on the slideway 22 and is prevented from sliding down to the carrying arm 41. The blocking of the packaged food 21 by the first lever arm 411 reduces the sliding speed of the packaged food 21 on the carrying arm 41, and indirectly reduces the sliding speed of the subsequent packaged food 21 on the dispensing tray 2. In certain embodiments, the packaged food 21 exerts a pushing force on the first lever arm 411 to overcome the friction and slowly turns the first lever arm 411 from the upright position to a flat position. In certain embodiments, the first lever arm 411 is rotatable by a sliding force exerted from the packaged food 21, or by a first rotational torque controlled by the collection mechanism.

When the engaging mechanism 42 moves the carrying arm 41 linearly away from the dispensing tray 2, the engaging feature 413 is disengaged from the actuating pin 231 to rotate the pivotable gate 23 back to the locked position. The locking pin 232 is rotated up to raise the rear side of the collected packaged food 21 and prevent the subsequent packaged food 21 from sliding down to the carrying arm 41. When the locking pin 232 is returned to the closed position, the subsequent packaged food 21 is secured on the slideway 22 without further sliding. When the first lever arm 411 is rotated to the flat position, the packaged food 21 further slides down and stopped by the second lever arm 412 at an opposite end of the platform 414 away from the engaging feature 413. The second lever arm 412 is rotatable between an upright position and a dispensing position by a second rotational torque controlled by the collection mechanism.

Figure 11:
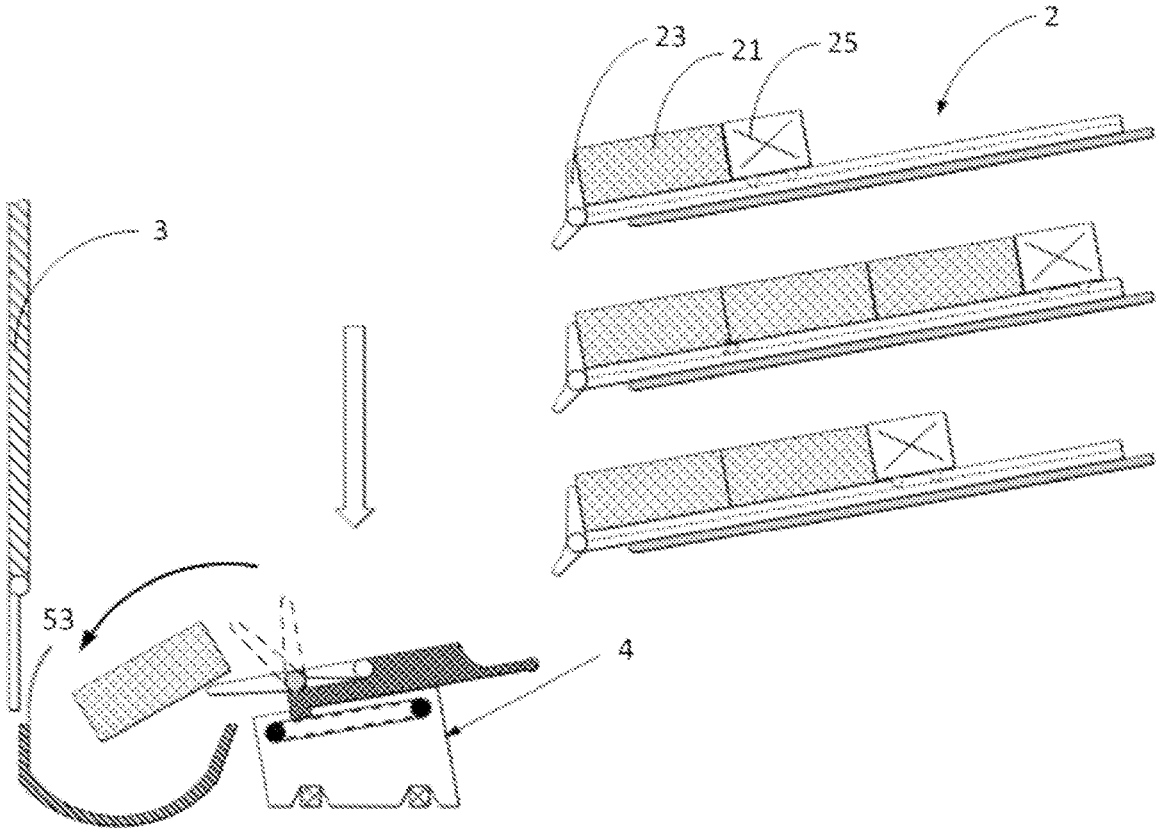
FIG. 11 is a side view illustrating the transfer of food to the delivery location of the frame in accordance with certain embodiments of the present disclosure.

When the packaged food 21 is completely slid into the platform 414 of the carrying arm 41, since the second lever arm 412 is set to the upright position, the second lever arm 412 can block and buffer the sliding speed of the packaged food 21. As shown in FIG. 11, the carrier structure 4 is moved along the frame 3 to the pick-up chamber 53 with the packaged food 21. In certain embodiments, the carrier structure 4 is descended to the pick-up chamber 53. Then the collection mechanism 43 rotates the second lever arm 412 from the upright position to a dispensing position. The inclination of the carrying arm 41 enables the packaged food 21 to slide down from the carrying arm 41 to the pick-up chamber 53 for the user to collect.

In certain embodiments, in order to ensure that the packaged food 21 slid out from the slideway 22 can move to the carrying arm 41 smoothly, and can further slide out of the carrying arm 41 to the pick-up chamber 53 when the second lever arm 412 is moved to the dispensing position, the inclination angle of the carrying arm 41 is larger than the tilting angle A of the dispensing tray 2. In one embodiment, the difference in the inclination angle is 10 degrees or less, or more preferably, between 4 degrees and 8 degrees. Therefore, the carrying arm 41 is tilted by an inclination angle approximately 14-33 degrees from the horizontal axis H.

This illustrates the fundamental structure of the automatic vending machine in accordance with the present disclosure. It will be apparent that variants of the above-disclosed and other features and functions, or alternatives thereof, may be combined into many other different systems or applications. The present embodiment is, therefore, to be considered in all respects as illustrative and not restrictive. The scope of the disclosure is indicated by the appended claims rather than by the preceding description, and all changes that come within the meaning and range of equivalency of the claims are therefore intended to be embraced therein.

What is claimed is:

1. A vending machine, comprising:

a storage and dispenser unit comprising plural dispensing trays arranged in an array for storing one or more packaged foods, a frame, and a carrier structure, wherein:

each individual dispensing tray comprises a pivotable gate and a slideway inclined by a tilting angle from a horizontal axis;

the carrier structure comprises:

a carrying arm having an engaging feature;

an engaging mechanism for actuating the pivotable gate; and a collection mechanism configured to receive the packaged food from the individual dispensing tray, wherein the collection mechanism comprises a first lever arm and a second lever arm, both disposed on the carrying arm;

the engaging mechanism is configured to move the carrying arm towards the individual dispensing tray such that the engaging feature actuates the pivotable gate from a locked position to an unlocked position;

the packaged food is prevented from sliding down when the pivotable gate is at the locked position;

the packaged food is slidable relative to the individual dispensing tray when the pivotable gate is at the unlocked position;

the first lever arm is rotatable between an upright position and a flat position;

the first lever arm at the upright position stops a subsequent packaged food from sliding down to the carrying arm; and the first lever arm is rotated to the flat position when the engaging feature moves away from the pivotable gate.

2. The vending machine of claim 1, wherein the pivotable gate comprises an actuating pin and a locking pin; and the engaging feature interacts with the actuating pin to actuate the pivotable gate.

3. The vending machine of claim 2, wherein the locking pin is rotated from a closed position and an opened position when the engaging feature interacts with the actuating pin.

4. The vending machine of claim 1, wherein the engaging mechanism comprises one or more pulleys and a belt, wherein the belt is coupled to the carrying arm such that a rotating motion of the one or more pulleys is transferred to a linear movement of the carrying arm.

5. The vending machine of claim 1, wherein the pivotable gate is spring-loaded such that the pivotable gate is returned to the locked position when the engaging feature is disengaged.

6. The vending machine of claim 1, wherein a weight block is slidably installed in the slideway to exert a pushing force to the packaged food.

7. The vending machine of claim 6, wherein:

the weight block comprises one or more guide bumps;

the individual dispensing tray further comprises one or more guide grooves provided at an inner bottom surface of the slideway; and the one or more guide bumps are installed in the one or more guide grooves to provide a contact surface with a low friction.

8. The vending machine of claim 1, wherein the first lever arm is rotatable by a sliding force exerted from the packaged food or by a first rotational torque controlled by the collection mechanism.

9. The vending machine of claim 1, wherein:

the second lever arm is rotatable between an upright position and a dispensing position;

the second lever arm at the upright position blocks and buffers a sliding speed of the packaged food; and the second lever arm is rotated to the dispensing position to enable the packaged food to slide down from the carrying arm to a pick-up chamber for collection.

10. The vending machine of claim 9, wherein the second lever arm is rotatable by a second rotational torque controlled by the collection mechanism.

11. The vending machine of claim 1, wherein the slideway is made of stainless steel, metal, thermally conductive ceramic, thermally conductive plastic, or a smooth material with good thermal conductivity.

12. The vending machine of claim 1, wherein the individual dispensing tray further comprises a heating element arranged under the slideway, thereby the heating element and the packaged food are closely fit to realize an effective and rapid heat transfer.

13. The vending machine of claim 12, wherein the heating element is a tubular heating rod comprising an internal heating coil and a protective cover.

14. The vending machine of claim 12, wherein the heating element is provided on sidewalls of the slideway.

15. The vending machine of claim 1 further comprising a control compartment having a payment unit, a display module, a pick-up chamber, and a central processing unit.

16. The vending machine of claim 1, wherein the carrying arm is tilted by an inclination angle of 14-33 degrees from the horizontal axis.

17. The vending machine of claim 1, wherein the individual dispensing tray comprises one or more heat insulation layers for maintaining a different temperature on the slideway, wherein the heat insulation layer is made of an aerogel thermal insulation material, or other materials with high temperature resistance.

18. A vending machine, comprising:

a storage and dispenser unit comprising plural dispensing trays arranged in an array for storing one or more packaged foods, a frame, and a carrier structure, wherein:

each individual dispensing tray comprises a pivotable gate and a slideway inclined by a tilting angle from a horizontal axis;

the carrier structure comprises:

a carrying arm having an engaging feature; and an engaging mechanism for actuating the pivotable gate;

the engaging mechanism is configured to move the carrying arm towards the individual dispensing tray such that the engaging feature actuates the pivotable gate from a locked position to an unlocked position;

the packaged food is prevented from sliding down when the pivotable gate is at the locked position;

the packaged food is slidable relative to the individual dispensing tray when the pivotable gate is at the unlocked position, wherein the individual dispensing tray further comprises a heating element arranged under the slideway, thereby the heating element and the packaged food are closely fit to realize an effective and rapid heat transfer;

and an ultra-high temperature (UHT) sterilization mechanism for sterilizing the slideway, wherein:

the UHT sterilization mechanism is repeated for all rows of the plural dispensing trays; and any two rows of the plural dispensing trays are not sterilized simultaneously to minimize current surge.

* * * * *